United States Patent [19]

Hirsch et al.

[11] Patent Number: 4,789,580

[45] Date of Patent: Dec. 6, 1988

[54] PROCESS OF REDUCING HIGHER METAL OXIDES TO LOWER METAL OXIDES

[75] Inventors: Martin Hirsch, Friedrichsdorf; Hermann Lommert, New Isenburg; Harry Serbent, Hanau am Main, all of Fed. Rep. of Germany

[73] Assignee: Metallgesellschaft Aktiengesellschaft, Frankfurt am Main, Fed. Rep. of Germany

[21] Appl. No.: 930,351

[22] Filed: Nov. 13, 1986

[30] Foreign Application Priority Data

Nov. 15, 1985 [DE] Fed. Rep. of Germany ..... 3540541

[51] Int. Cl.[4] ..... C01G 45/02; C01G 49/04

[52] U.S. Cl. ..... 423/49; 423/148; 423/592; 423/605; 423/632; 75/26; 75/35; 75/36; 75/82; 75/91

[58] Field of Search ..... 423/168, 138, 148, 632, 423/633, 634, 594, 605, DIG. 16, 592, 49; 75/26, 35, 36, 82, 91

[56] References Cited

U.S. PATENT DOCUMENTS

| | | | |
|---|---|---|---|
| 2,310,258 | 2/1943 | Riveroll | 75/80 |
| 2,745,730 | 5/1956 | De Vannay | 75/1 R |
| 2,913,331 | 11/1959 | Dean | 423/138 |
| 3,276,858 | 10/1966 | Pfeiffer et al. | 423/148 |
| 3,375,098 | 3/1968 | Marshall | 423/138 |
| 3,721,548 | 3/1973 | Hodge et al. | 423/138 |
| 4,044,094 | 8/1987 | Barner et al. | 423/32 |
| 4,049,575 | 9/1977 | Sasaki et al. | 502/211 |
| 4,070,181 | 1/1978 | Widell | 75/91 |
| 4,072,507 | 2/1978 | Rajcevic et al. | 75/74 |
| 4,087,274 | 3/1978 | Edenwall et al. | 75/10 R |
| 4,185,996 | 1/1980 | Zambrano | 423/138 |
| 4,670,244 | 6/1987 | Roos et al. | 423/138 |

FOREIGN PATENT DOCUMENTS

| | | | |
|---|---|---|---|
| 0035653 | 6/1973 | Australia | 423/138 |
| 4628485 | 8/1984 | Australia | 423/138 |
| 0955384 | 1/1950 | France | 423/605 |
| 1564579 | 8/1969 | France | 423/49 |
| 2318938 | 7/1975 | France | 423/49 |
| 0008400 | 10/1912 | United Kingdom | 423/49 |

*Primary Examiner*—Anthony McFarlane
*Attorney, Agent, or Firm*—Felfe & Lynch

[57] ABSTRACT

Disclosed is a process to effect a reduction to a desired, constant degree as exactly as possible and to achieve a low surplus of carbon. The reduction by treatment with carbonaceous reducing agents is effected in such a manner that fine-grained solids, which contain higher metal oxides, are calcined at 800° to 1100° C. with hot gases in which the solids are suspended. The calcined solids are reduced at a temperature in the range of from 800° to 1100° C. to form low metal oxides in a stationary fluidized bed, which is supplied with carbonaceous reducing agents and oxygen-containing gases. The carbonaceous reducing agents are supplied to the stationary fluidized bed at such a rate so as to reduce the higher metal oxides to low metal oxides, while maintaining the reduction temperature in the stationary fluidized bed and insuring that the discharged matter has the desired carbon content. The stationary fluidized bed exhaust gas is supplied as secondary gas to the calcining step, and fuel is supplied to the calcining step at a rate such that the total of the heat generated by the combustion of the fuel and of the heat suplied by the exhaust gas provides the heat which is required for calcination.

7 Claims, 1 Drawing Sheet

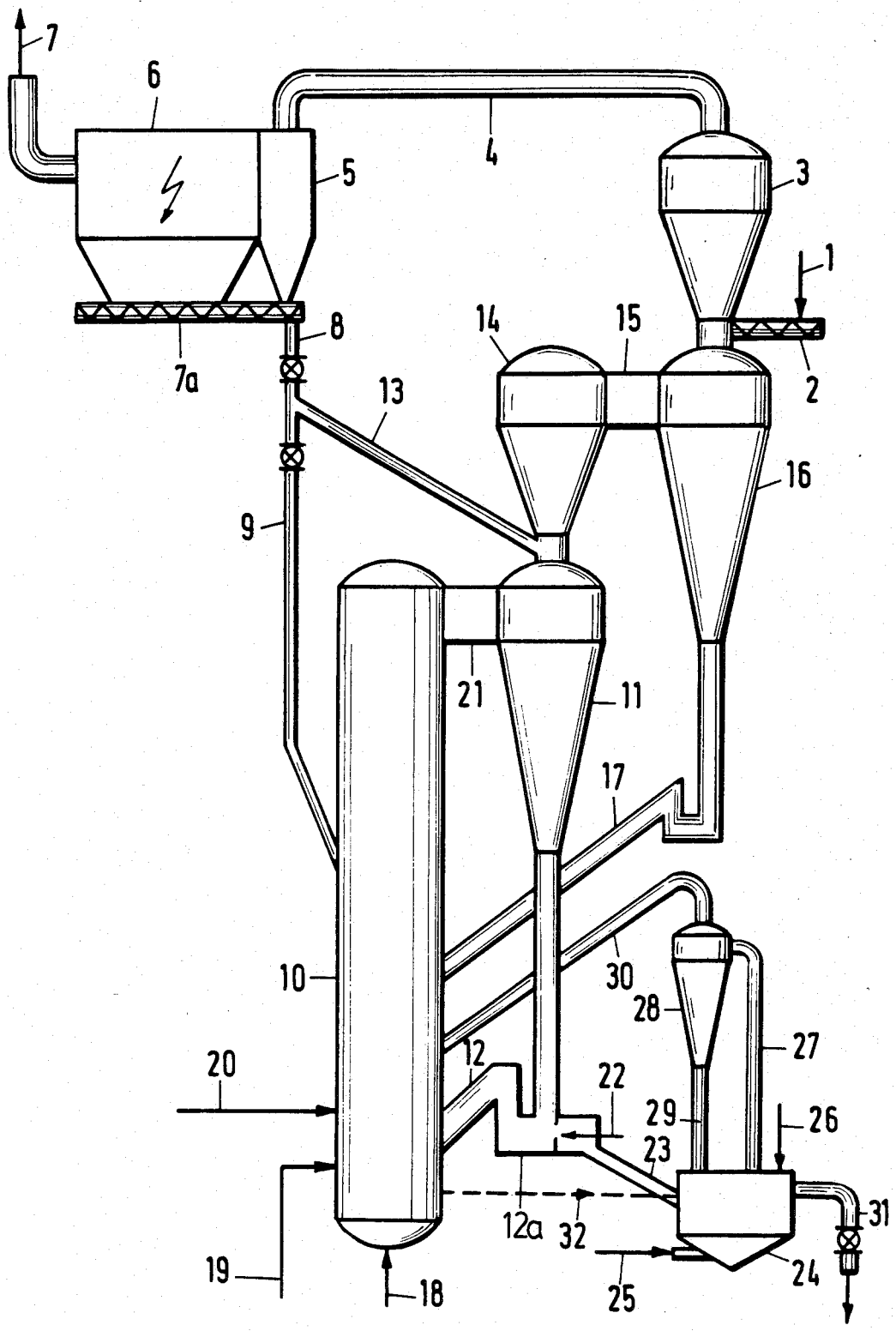
7
6
5
4
3
1
8
14
15
2
7a
13
16
9
21
11
17
10
30
28
27
20
12
22
29
26
23
12a
32
31
19
18
25
24

PROCESS OF REDUCING HIGHER METAL OXIDES TO LOWER METAL OXIDES

BACKGROUND OF THE INVENTION

The present invention is in a process for reducing higher metal oxides to lower metal oxides by treatment with a carbonaceous reducing agent.

Ores which contain metals, such as Fe, Ni, Mn, in the form of higher oxides must sometimes be subjected to a reducing treatment to obtain the metals in a lower oxide form. This is particularly required in processes of producing iron-nickel alloys from iron-nickel ores.

Poor ores, such as lateritic ores, must increasingly be used to meet the demand of industry for nickel, particularly in alloys with iron. Most of the poor ores contain Fe and Ni in a ratio such that a complete reduction of both metals, and a separation of the gangue in a molten state as slag, would result in a ferroalloy which is so poor in nickel that it would not be commercially acceptable.

For instance, in an ore containing 30% Fe and 2% Ni the ratio of Fe to Ni is 15:1. However, the Fe:Ni ratio in commercial ferroalloys is not in excess of 4:1, which means that they contain at least 20% nickel.

For this reason the processing of such ores includes a preliminary reduction, by which they are reduced, as closely as possible, to an FeO state and a succeeding melting process, in which metallic iron is produced by a further reduction only in that amount which is permissible for the desired ferroalloy. The remaining iron oxide is slagged.

On a commercial scale, the preliminary reduction is effected in a rotary kiln and coal is used as the reducing agent. A problem arising in connection with the preliminary reduction in a rotary kiln is that the iron oxide must be reduced by the preliminary reduction exactly to a prescribed degree and that the discharged material must contain surplus solid carbon only in an amount which is still permissible for the further reduction in the melting process to the desired content of metallic iron. Formation of metallic iron by the preliminary reduction must be avoided even though the degree of reduction achieved by the preliminary reduction in the rotary kiln is subject to relatively strong fluctuations. As such, the preliminary reduction is not effected as far as to the FeO state but, for the sake of precaution, only to a much higher degree of oxidation so that a larger reduction work must be performed in the melting process, which is effected in electric furnaces in most cases. As a result, the overall process becomes more expensive. Additionally, control of further reduction during the melting process is difficult because the degree of oxidation and the carbon content of the matter discharged from the rotary kiln often fluctuate, even in the case of small kilns.

Such a process has been described in TMS-AIME Paper Selection, Paper No. 74–40, pages 1–23.

Another case relates to the reduction of ores which contain higher manganese oxides to be reduced to lower manganese oxides.

SUMMARY OF THE INVENTION

It is an object of the invention to effect a reduction of higher metal oxides to the highest possible degree to lower metal oxides having the desired oxidation number, which degree should be as constant as possible, and to minimize the carbon content of the reduced matter which is discharged or to provide only a constant, small content of surplus carbon therein.

This and other objects are accomplished in accordance with the invention. In the process of the invention, fine-grained solids which contain higher metal oxides are calcined by a treatment at 800° to 1100° C. with hot gases, in which the solids are suspended. The calcined solids are reduced from the higher metal oxides to lower metal oxides at a temperature in the range of from 800° to 1100° C. in a stationary fluidized bed. The stationary fluidized bed is supplied with carbonaceous reducing agents and oxygen-containing gases. The carbonaceous reducing agent is supplied to the fluidized bed at such a rate that the carbon which is supplied is effective to reduce the higher metal oxides to low metal oxides, to maintain the reduction temperature, and to maintain the desired carbon content in the matter discharged. The exhaust gas from the stationary fluidized bed is used as a secondary gas in the calcining step. Fuel is supplied to the system for the calcining step at such a rate that the total of the heat generated by the combustion of such fuel and of the heat supplied to the calcining step by the exhaust gas from the stationary fluidized bed will be sufficient to effect the calcination.

The solids have a particle size below 3 mm.

By the calcination, water of crystallization is eliminated, carbonates are decomposed with formation of $CO_2$, and any moisture which is present is evaporated. The calcination is effected under oxidizing conditions. The hot gases may be produced by a combustion of solid, liquid and gaseous fuels.

The calcination may be effected in a stationary fluidized bed or a circulating fluidized bed or by a different process in which the solids are suspended in a gas stream. The raw materials may be dried before they are calcined. That drying may be effected with the waste heat from the calcining step. In that case water will be evaporated without a consumption of carbon. Besides, the water vapor need not be heated to the much higher temperature used for calcination and the waste heat will be utilized in a favorable manner. The dried solids may be heated further before they are supplied to the calcining step and such further heating may result in a preliminary calcination to a certain degree.

The solids withdrawn from the calcining step are subjected to a preliminary reduction in a stationary (orthodox) fluidized bed. A stationary fluidized bed is a fluidized bed in which a dense phase is separated by a distinct density step from the overlying dust-laden space and the two states of distribution are separated by a defined boundary layer.

The oxygen-containing gases are supplied as fluidizing gas to the stationary fluidized bed at such a rate that the carbonaceous reducing agent is virtually completely gasified or is gasified to such a degree that the discharged matter has a desired content of surplus carbon. The oxygen-containing gases generally consist of air.

The actual amount of supplied carbonaceous reducing agent in the stationary fluidized bed is calculated based on the heat balance (maintain the reduction temperature) as well as the amount required for the reduction step and the desired carbon content in the discharged matter. The reduction step is performed under the required reducing conditions so that the waste gas from the stationary fluidized bed contains CO and $H_2$ in such amount which is necessary in accordance with the thermodynamic conditions.

In a preferred embodiment, the calcining step is effected in a circulating fluidized bed. The suspension discharged from the fluidized bed reactor is supplied to a separator, at least one partial stream of the separated solids is recycled to the reactor, and the exhaust gas is supplied to suspension heat exchangers for drying and preheating the solids which contain higher metal oxides. The system of the circulating fluidized bed consists of a fluidized bed reactor, a separator and a recycling line for recycling solids from the separator to the fluidized bed reactor.

Whereas an orthodox fluidized bed constitutes a dense phase, which is separated by a distinct density step from the overlying gas space, the fluidized bed in the fluidized bed reactor of the circulating fluidized bed contains states of distribution having no defined boundary layer. There is no density step between a dense phase and an overlying gas space but the solids concentration in the reactor gradually decreases from bottom to top. If the operating conditions are defined by the Froude and Archimedes numbers, the following ranges will be obtained:

$$0.1 \leqq 3/4 \times Fr^2 \times \frac{\rho_g}{\rho_k - \rho_g} \leqq 10$$

and $$0.01 \leqq Ar \leqq 100$$

wherein $$Ar = \frac{d_k 3 \times g(\rho_k - \rho_g)}{\rho_g \times \nu^2}$$

and $$Fr^2 = \frac{u^2}{g \times d_k}$$

In said equations
u=the relative gas velocity in m/sec
Ar=the Archimedes number
Fr=the Froude number
$\rho_g$=the density of the gas in kg/m$^3$
$\rho_k$=the density of the solid particle in kg/m$^3$
$d_k$=the diameter of the spherical particle in m
$\nu$=the kinematic viscosity in m$^2$/sec
g=the acceleration due to gravity in m/sec$^2$ In order to form a circulating fluidized bed, the solids entrained by the gases from the fluidized bed reactor are recycled to the fluidized bed reactor so that the quantity of solids circulated per hour is at least five times the weight of the solids contained in the shaft of the reactor. At the rate at which solids are charged, solids are withdrawn from the system of the circulating fluidized bed and are supplied to the stationary fluidized bed. The circulating fluidized bed will effect a calcination at a high throughput rate and a combustion of the fuel to a high degree and owing to the multistage combustion will ensure that the exhaust gas has only low contents of CO and $NO_x$.

In a preferred embodiment, the exhaust gas coming from the stationary fluidized bed and used as secondary gas in the calcining step, is passed through a separator before being supplied to the calcining step. The separated solids are recycled to the stationary fluidized bed. The dust-collecting separator suitably consists of a cyclone. In that case a recycling of solids from the reducing stage to the oxidizing stage will be substantially avoided.

In a preferred embodiment, solid carbonaceous reducing agents are supplied to the stationary fluidized bed wherein the reduction occurs. The supply of solid fuel will result in an improved distribution in the fluidized bed and will permit a very exact maintenance of a uniform content of surplus carbon in the discharged matter.

In a preferred embodiment, iron-nickel ores are charged and carbonaceous reducing agent is supplied in step (c) to the stationary fluidized bed at such a rate as to effect a reduction of the higher iron oxides approximately to an FeO state, a reduction of the nickel oxides, and a maintenance of the reduction temperature in the bed during reduction and of a content of surplus carbon not in excess of 2% by weight in the matter discharged. The discharged matter is processed further in a molten state with formation of metallic iron in the amount required for the desired iron-nickel alloy. The remaining iron content is slagged.

In a further embodiment, materials which contain manganese oxides are processed and carbonaceous reducing agent is supplied to the stationary fluidized bed at a rate so as to effect a reduction of the higher manganese oxides, approximately to the MnO state and a maintenance of the reduction temperature in the bed and to minimize the surplus carbon contained in the discharged matter The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWING

The FIGURE schematically depicts the process of the invention.

DESCRIPTION OF THE PREFERRED EMBODIMENT

Referring to the FIGURE, ore 1 is charged, by a screw conveyor 2, into a venturilike suspension dryer 3, in which the ore is suspended in a gas stream. The suspension is then conveyed through line 4 to a separator 5. The gas is purified in an electrostatic precipitator 6 and is then discharged as exhaust gas 7. The collected solids are fed by a screw conveyor 7a into line 8. A partial stream from line 8 is supplied through line 9 to a calcining system. The calcining system includes a circulating fluidized bed which consists of a fluidized bed reactor 10, a recycling cyclone 11 and a recycling line 12.

That portion of the solids from line 8 which is not fed through line 9 into the calcining system is supplied through line 13 to a preheater 14 and is suspended therein in a gas stream. The preheated suspension is subsequently supplied through line 15 to a separator 16. The solids collected in separator 16 are supplied through line 17 to the reactor 10. The off gas from the separator 16 flows into suspension dryer 3.

Fluidizing air 18 is supplied to the lower portion of the reactor 10. Secondary air 19 and coal 20 are supplied to the reactor 10 on a higher level. A gas-solids suspension is formed in and fills the entire fluidized bed reactor 10. The gas-solids suspension passes out from the top of the reactor 10 and is supplied in line 21 to a recycling cyclone 11 wherein the suspension is separated into solids and gas. The gas flows into the preheater 14 and the separated solids enter the recycling line 12, which contains a siphon trap 12*a*. Trap 12*a* is supplied at its bottom with fluidizing air at a low rate (not shown).

From the trap 12*a*, a portion of the calcined solids flows through a controllable valve 22 and a line 23 to the reactor 24, which contains the stationary fluidized bed, in which reduction is effected. Fluidizing air is blown through line 25 into the lower portion of the reactor 24, which is supplied with coal through line 26. The dust-laden exhaust gas from the reactor 24 is conducted in line 27 to the separator 28. The therein collected solids are recycled through line 29 to the stationary fluidized bed in reactor 24. The exhaust gas from the separator 28 is supplied through line 30 to the fluidized bed reactor 10 and enters the same above the lines 12, 19 and 20 and below the line 17. The reduced material is discharged through line 31. Calcined solids may be supplied through line 32 to the reactor 24 which contains the stationary fluidized bed.

EXAMPLE

The reference numerals are consistent with those used in the FIGURE.

The screw conveyor 2 delivered 100,000 kg/h of the lateritic ore into the system. The lateritic Ni ore had the following contents based on dry ore:

| | | | |
|---|---|---|---|
| $Fe_2O_3$ | 20%; | $SiO_2$ | 33.0% |
| NiO | 2%; | MgO | 26.9% |
| $CaCO_3$ | 6.8%; | | |
| water of hydration | 9.9%; | | |
| moisture of wet ore | 13.7% | | |

The fluidized bed reactor 10 was 3.7 m in diameter and had a height of 16 m. A temperature of 900° C. was maintained in the reactor during operation.

Fluidizing air (line 18) was introduced into reactor 10 at a rate of 20,000 $sm^3/h$ Secondary air (line 19) was fed into reactor 10 at a rate of 22,600 $sm^3/h$. The coal (line 20) was fed into the reactor at a feed rate of 4,260 kg/h. The coal 20 contained:

81.8% C;
2.6% H;
5.6% 0;
3.3% ash;
6.7% moisture;

and had a lower heating value $H_u$ of 7,043 kcal/kg. The volume of the exhaust gas from reactor 10 (line 21) was 58,600 $sm^3/h$ at a temperature of 900° C.

The feed of line 8 was split so that 60% of solids from line 8 pass through the valves into line 9 and the remaining 40% of solids from line 8 were diverted into line 13.

The fluidized bed reactor 24 was 3 m in diameter and had a height of 2.5 m. A temperature of 900° C. was maintained in the reactor. In the operation of reactor 24, 6,030 $sm^3/h$ were introduced as fluidizing air (line 25) and coal (line 26) was introduced at a rate of 3,430 kg/h. 9,430 $sm^3/h$ of gas was exhausted from reactor 24 (line 27). The exhaust gas had the following composition:

18.2% CO;
17.6% $CO_2$;
6.3% $H_2$;
7.4% $H_2O$; and
50.5% $N_2$.

The material discharged through line 31 amounted to 72,650 kg/h and had the following composition:

21.4% FeO; 39.2% $SiO_2$
1.9% Ni; 32.0% MgO
1.3% C. 4.5% CaO

The system exhaust gas (line 7) was 82,000 $sm^3/h$ and had the following makeup:

13.7% $CO_2$;
37.8% $H_2O$
46.7% $N_2$; and
1.8% $O_2$ at a temperature of 140° C.

Thus the process of the invention provides an advantage in that the calcination is effected with very high economy and with production of a substantially completely burnt exhaust gas having a low pollutant content and that a reduced product is obtained which has been reduced to an exactly controlled, uniform degree and has an exactly defined, uniform content of surplus carbon or a zero carbon content In the application to the reduction of iron-nickel ores, the iron oxides may substantially be reduced to FeO whereas a formation of metallic iron is avoided. The carbon content of the discharged matter may be minimized or may be maintained at the low, absolutely uniform level that is required for a reduction by which only a small amount of metallic iron is formed in the melting process. For this reason the rate at which carbon is supplied to the electric furnace can be exactly controlled.

It will be understood that the specification and examples are illustrative but not limitative of the present invention and that other embodiments within the spirit and scope of the invention will suggest themselves to those skilled in the art.

We claim:

1. A process of reducing the higher valencies of a metal oxide to lower valencies of the metal oxide comprising:

(a) calcining in a circulating fluidized bed reactor fine-grained solids which contain metal oxides of higher valency at at a temperature of 800° to 1100° C. under oxidizing conditions with hot gases, in which the solids are suspended;

(b) reducing the calcined solids at a reduction temperature in a rnage of from 800° to 1100° C. in a stationary fluidized bed which is supplied with a carbonaceous reducing agent and oxygen-containing gases to reduce the higher metal oxides to lower metal oxides;

(c) supplying the carbonaceous reducing agent to the stationary fluidized bed and removing discharge matter from said bed, the carbonaceous reducing agent being supplied at a rate effective to reduce the higher valency metal oxide to a lower valency metal oxide, to maintain the reduction temperature, and to maintain a carbon content in the discharged matter;

(d) removing exhaust gas from the stationary fluidized bed and introducing the exhaust gas as a secondary gas in the circulating fluidized bed in the calcining step; and (e) supplying fuel to the calcining step (a) and substantailly completely combusting the fuel and the exhaust gas, the fuel being supplied at such a rate that the total of the heat generated by the substantially complete combustion of said fuel and of the heat supplied to the calcining step by the combustion of the exhaust gas from step (d) is sufficient to effect the calcination.

2. The process of claim 1, wherein a suspension is discharged from the circulating fluidized bed reactor and is supplied to a separator wherein solids are separated, at least a portion of the separated solids is recycled to said reactor, and the exhaust gas is supplied to a suspension heat exchanger for drying and preheating the solids which contain the higher metal oxide.

3. The process of claim 1, wherein the exhaust gas of the stationary fluidized bed is passed through a separator ot separate solids therefrom before being supplied to the calcining step, and the solids separated from the exhaust gas are recycled to the stationary fluidized bed.

4. The process of claim 1, wherein the solids are iron-nickel ores containing oxides of nickel and iron and the carbonaceous reducing agent is supplied in step (c) to the stationary fluidized bed at such a rate so as to effect a reduction of the higher valency iron oxide substantially to an FeO state, a reduction of the nickel oxide, and the mantenance of the reduction temperature in step (b) and of the content of carbon not in excess of 2% by weight in the matter discharged.

5. The process of claim 4, wherein tne discharged matter is processed further in a molten state to form metallic iron in an amount sufficient for making an iron-nickel alloy, and wherein any remaining iron present in said discharge matter is slagged.

6. The process of claim 1, wherein the higher valency metal oxide is a maganese oxide containing material and carbonaceous reducing agent is supplied in step (c) to the stationary fluidized bed at such a rate so as to effect a reduction of maganese oxide of higher valency substantially to the MnO state, and a maintenance of the reduction temperature in step (b) and to minimize the amount of carbon contained in the discharged matter.

7. The process of claim 1 wherein the carbonaceous reducing agent which us supplied to the reducing step (b) is a solid.

* * * * *